US010178482B2

(12) United States Patent
Yang et al.

(10) Patent No.: US 10,178,482 B2
(45) Date of Patent: Jan. 8, 2019

(54) AUDIO TRANSMISSION SYSTEM AND AUDIO PROCESSING METHOD THEREOF

(71) Applicant: Unlimiter MFA Co., Ltd., Eden Island (SC)

(72) Inventors: Kuo-Ping Yang, Taipei (TW); Jian-Ying Li, Taipei (TW); Kuan-Li Chao, Taipei (TW); Neo Bob Chih-Yung Young, Taipei (TW)

(73) Assignee: UNLIMITER MFA CO., LTD., Eden Island (SC)

( * ) Notice: Subject to any disclaimer, the term of this patent is extended or adjusted under 35 U.S.C. 154(b) by 0 days.

(21) Appl. No.: 15/439,982

(22) Filed: Feb. 23, 2017

(65) Prior Publication Data

US 2017/0366905 A1 Dec. 21, 2017

(30) Foreign Application Priority Data

Jun. 15, 2016 (TW) ..... 105118720 A

(51) Int. Cl.
*H04R 25/00* (2006.01)

(52) U.S. Cl.
CPC ..... *H04R 25/505* (2013.01); *H04R 25/43* (2013.01); *H04R 25/554* (2013.01); *H04R 25/558* (2013.01); *H04R 2225/43* (2013.01); *H04R 2225/61* (2013.01)

(58) Field of Classification Search
CPC .... H04R 25/30; H04R 25/505; H04R 25/554; H04R 25/558; H04R 2225/43
USPC ..... 381/312, 314, 60
See application file for complete search history.

(56) References Cited

U.S. PATENT DOCUMENTS

2009/0076636 A1* 3/2009 Bradford ..... G10L 21/02 700/94
2015/0281853 A1* 10/2015 Eisner ..... H04R 25/505 381/312

* cited by examiner

*Primary Examiner* — Sunita Joshi
(74) *Attorney, Agent, or Firm* — Bacon & Thomas, PLLC

(57) ABSTRACT

An audio transmission system and an audio processing method thereof are disclosed. The audio transmission system includes a wireless communication module, a sound receiving module, a memory module, a sound adjustment module, and an output module. The wireless communication module is used for receiving a wireless communication signal or a wireless audio signal from an electronic device. The sound receiving module is used for receiving an ambient sound signal. The memory module stores a first parameter, a second parameter, and a third parameter. The sound adjustment module adjusts the received wireless communication signal, the wireless audio signal, or the ambient sound signal according to the first parameter, the second parameter, or the third parameter so as to generate an adjusted sound signal. The output module is used for outputting the adjusted sound signal.

7 Claims, 2 Drawing Sheets

AUDIO TRANSMISSION SYSTEM AND AUDIO PROCESSING METHOD THEREOF

BACKGROUND OF THE INVENTION

1. Field of the Invention

The present invention relates to an audio transmission system and an audio processing method thereof; more particularly, the present invention relates to an audio transmission system and an audio processing method thereof for adjusting the audio under different usage modes.

2. Description of the Related Art

With advances in science and technology, assistive devices for the disabled, such as hearing aids for the hearing impaired, are increasingly used in modern society. Currently, a new audio transmission system has been developed to have a receiving sound module and an emitting sound module with different usage scenarios. For example, the hearing aid may have a telephony mode for transferring sound bidirectionally or a music mode for receiving sound unidirectionally. However, the audio transmission system does not adjust the emitted sound according to different usage scenarios. The lack of adjustment causes inconvenience to the user if the user desires an improved sound effect.

Therefore, it is necessary to invent a new audio transmission system and an audio processing method thereof to mitigate and/or obviate the aforementioned problems.

SUMMARY OF THE INVENTION

It is an object of the present invention to provide an audio transmission system for adjusting the audio under different usage modes.

It is another object of the present invention to provide an audio processing method applied to the abovementioned audio transmission system.

To achieve the abovementioned object, the audio transmission system is used for establishing a connection with the electronic device and has a telephony usage mode, a music usage mode, and an ambient sound usage mode. The audio transmission system comprises a wireless communication module, a sound receiving module, a memory module, a sound adjustment module, and an output module. The wireless communication module is used for receiving a wireless communication signal or a wireless audio signal from the electronic device, wherein the wireless communication signal is used to execute the telephony usage mode and the wireless audio signal is used to execute the music usage mode. The sound receiving module is used for receiving an ambient sound signal, wherein the ambient sound signal is used to execute the ambient sound usage mode. The memory module is used for storing a first parameter, a second parameter, and a third parameter. The sound adjustment module is electrically connected to the wireless communication module, the sound receiving module, and the memory module for adjusting the wireless communication signal, the wireless audio signal, or the ambient sound signal which is received according to the first parameter, the second parameter, or the third parameter respectively to generate an adjusted sound signal. The output module is electrically connected to the sound adjustment module for outputting the adjusted sound signal.

The audio processing method comprises the following steps: providing a wireless communication module for receiving a wireless communication signal or a wireless audio signal from the electronic device, wherein the wireless communication signal is used to execute the telephony usage mode and the wireless audio signal is used to execute the music usage mode; providing a sound receiving module for receiving an ambient sound signal, wherein the ambient sound signal is used to execute the ambient sound usage mode; adjusting the wireless communication signal, the wireless audio signal, or the ambient sound signal which is received according to a first parameter, a second parameter, or a third parameter respectively to generate an adjusted sound signal; and outputting the adjusted sound signal.

Other objects, advantages, and novel features of the invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

These and other objects and advantages of the present invention will become apparent from the following description of the accompanying drawings, which disclose several embodiments of the present invention. It is to be understood that the drawings are to be used for purposes of illustration only, and not as a definition of the invention.

Figure 1:
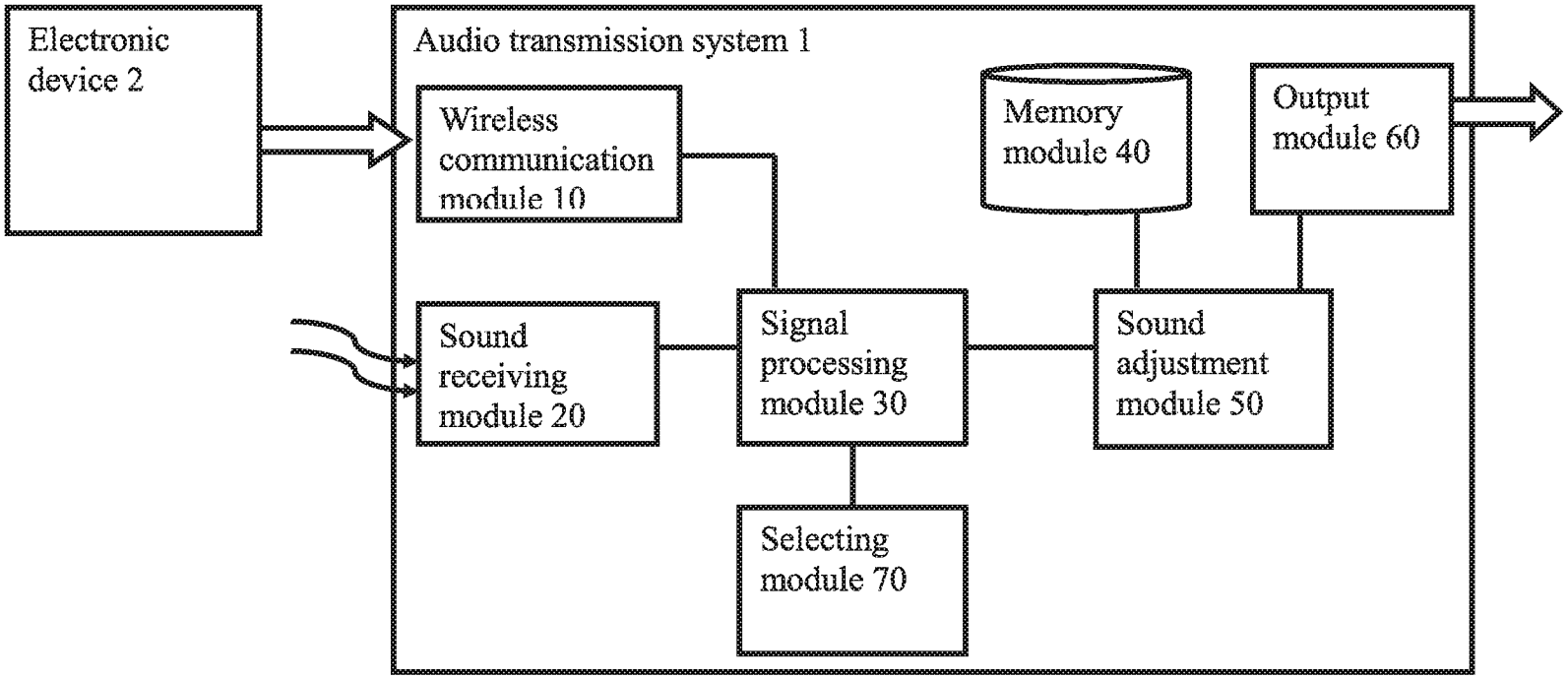
FIG. 1 illustrates a structural drawing of the audio transmission system of the present invention.

Please refer to FIG. 1, which illustrates a structural drawing of the audio transmission system of the present invention.

The audio transmission system 1 of the present invention can be a hearing aid or an earphone with a microphone, such as a Bluetooth earphone, but the present invention is not limited thereto. The audio transmission system 1 is used for establishing a connection with the electronic device 2 and has a telephony usage mode, a music usage mode, and an ambient sound usage mode, but the present invention is not limited to the audio transmission system 1 being able to execute only the aforementioned usage modes. In one embodiment of the present invention, the electronic device 2 can be a smart phone, a tablet, or a notebook. The audio transmission system 1 comprises a wireless communication module 10, a sound receiving module 20, a signal processing module 30, a memory module 40, a sound adjustment module 50, an output module 60, and a selecting module 70.

The wireless communication module 10 has a wireless communication function for receiving a wireless communication signal from the electronic device 2 via a Bluetooth, an NFC, or a WiFi protocol. In one embodiment of the present invention, the wireless communication module 10 can receive a wireless communication signal or a wireless audio signal. The wireless communication signal is a signal for transferring in a bidirectional way, and the wireless audio signal is a signal for receiving in a unidirectional way, but the present invention is not limited thereto. Therefore, the wireless communication signal can be used for executing a telephony usage mode and the wireless audio signal can be used for executing a music usage mode. The sound receiving module 20 can be a microphone for receiving an ambient sound signal which can be used for executing an ambient sound usage mode.

The signal processing module 30 is electrically connected to the wireless communication module 10 and sound receiving module 20 for determining whether the wireless communication module 10 and sound receiving module 20 have received an external signal; i.e., determining whether a wireless communication signal, a wireless audio signal, or an ambient sound signal is transferred to the audio transmission system 1. The memory module 40 is used for storing a plurality of parameters for different wireless signals and an ambient sound signal. Thus, in one embodiment of the present invention, the memory module 40 stores a first parameter, a second parameter, and a third parameter for the wireless communication signal, the wireless audio signal, and the ambient sound signal.

The sound adjustment module 50 is electrically connected to the wireless communication module 10, the sound receiving module 20, the signal processing module 30 and the memory module 40. The sound adjustment module 50 is used for directly adjusting the wireless communication signal, the wireless audio signal, and the ambient sound signal according to the first parameter, the second parameter, and the third parameter separately to generate an adjust sound signal. In one embodiment of the present invention, the sound adjustment module 50 is an equalizer, and the first parameter, the second parameter, and the third parameter are gain values for adjusting. Therefore, the first parameter can be a gain value for the wireless communication signal for adjusting so as to allow the user to have a better communication quality. The second parameter can be a gain value for the wireless audio signal so as to cause the wireless audio signal to generate a different audio effect. The third parameter can be a gain value for the ambient sound signal so as to gain and adjust the frequency of the ambient sound with a user's audiogram. Since the technique of establishing the audiogram is commonly applied by those skilled in the art and is not a focus of improvement of the present invention, there is no need for further explanation. As a result, the sound adjustment module 50 can adjust the received wireless communication signal, the wireless audio signal, or the ambient sound signal respectively according to the first parameter, the second parameter, or the third parameter previously stored in the memory module 40 to generate an adjusted sound signal.

Finally, the audio transmission system 1 further comprises an output module 60. The output module 60 is a speaker and is electrically connected to the sound adjustment module 50 for outputting the adjusted sound signal to the user.

Therefore, in one embodiment of the present invention, when the wireless communication signal is received, the signal processing module 30 executes the telephony usage mode so as to allow the user to communicate by telephone. When the wireless audio signal is received, the signal processing module 30 executes the music usage mode so as to allow the user to listen to music. Finally, when the ambient sound signal is received, the signal processing module 30 executes the ambient sound usage mode so as to allow the user to hear ambient sound. In one embodiment of the present invention, the telephony usage mode is a first processing order of the signal processing module 30, the music usage mode is a second processing order of the signal processing module 30, and the ambient sound usage mode is a third processing order of the signal processing module 30. In other words, when the wireless signal and the ambient sound signal are received at the same time, the sound adjustment module 50 adjusts only the wireless signal. When the wireless communication signal and the wireless audio signal are received at the same time, the sound adjustment module 50 first adjusts the wireless communication signal. Therefore, the audio transmission system 1 assigns priority to the telephony usage mode. If there is no wireless communication signal, the audio transmission system 1 will in turn determine whether the music usage mode and the ambient sound usage mode are executed.

However, the audio transmission system 1 can also have a selecting module 70 which is used to allow the user to select one usage mode, such that the audio transmission system 1 can only execute the telephony usage mode, the music usage mode, or the ambient sound usage mode. By this design, when the user selects the telephony usage mode, the audio transmission system 1 can receive and adjust only the wireless communication signal based on the first parameter. When the user selects the music usage mode, the audio transmission system 1 can receive and adjust only the wireless audio signal based on the second parameter. When the user selects the ambient sound usage mode, the audio transmission system 1 can receive and adjust only the ambient sound signal based on the third parameter. The selecting module 70 can also allow the user to select an automatic mode. Thus, the signal processing module 30 determines whether a wireless communication signal, a wireless audio signal, or an ambient sound signal is received directly and executes the adjustment process automatically based on the parameters.

It is to be known that each module of the audio transmission system 1 can be a hardware device, a software program combined with the hardware device, or a firmware combined with the hardware device, such as an application product stored in a computer access medium, but the present invention is not thus limited. Moreover, the present embodiment is intended to show a preferred embodiment of the present invention. To avoid further description, not all of the possible changes and combinations are described in detail. However, persons of ordinary skill in the art of the present invention may recognize that the abovementioned modules or units may not be necessary. To implement the present invention, the invention may also include other modules or units of the prior art. Each module or unit may be omitted or replaced based on design requirements, and other modules or units may be installed between any two modules.

Figure 2:
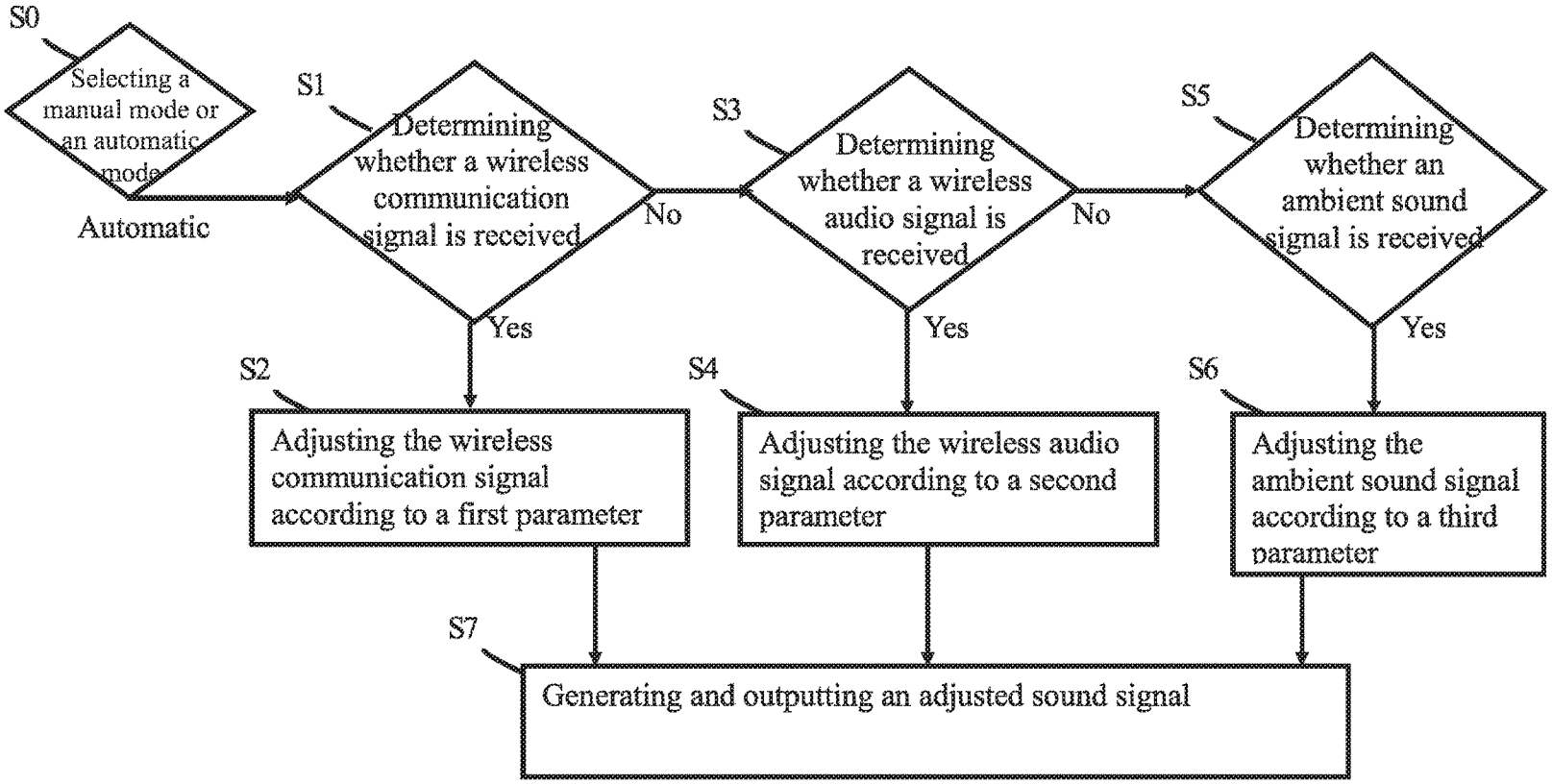
FIG. 2 illustrates a flowchart of the audio processing method of the present invention.

Please refer to FIG. 2, which illustrates a flowchart of the audio processing method of the present invention. It is to be known that, although the following description uses the abovementioned audio transmission system 1 to describe the audio processing method of the present invention, the audio processing method of the present invention is not limited to the structure of the audio transmission system 1.

When the sound providing apparatus 3 is providing sound, the processing module 14 will control the wireless transmission module 12 to establish a connection with the hearing aid 2. Thus a connection between the hearing aid 2 and the wireless transmission module 12 can be established to transmit the signal via a wireless communication path, e.g., a Bluetooth protocol.

Before executing the audio processing, first step S0 is performed: selecting a manual mode or an automatic mode.

First, the user uses the selecting module 70 to select a manual mode or an automatic mode. If the manual mode is selected, the audio transmission system 1 executes only the telephony usage mode, the music usage mode, or the ambient sound usage mode.

If the automatic mode is selected, step S1 is executed: determining whether a wireless communication signal is received.

If the wireless communication module 10 is receiving a wireless communication signal, then step S2 is executed: adjusting the wireless communication signal according to a first parameter.

The sound adjustment module 50 reads out the first parameter from the first memory module 40 so as to adjust the wireless communication signal which is received.

On the other hand, if the wireless communication module 10 does not receive a wireless communication signal, the signal processing module 30 executes step S3: determining whether a wireless audio signal is received.

Meanwhile, the signal processing module 30 can further determine whether the wireless communication module 10 is receiving a wireless audio signal.

If a wireless audio signal is received, step S4 is executed: adjusting the wireless audio signal according to a second parameter.

The sound adjustment module 50 will read the second parameter from the memory module 40 to adjust the wireless audio signal which is received.

If the wireless communication module 10 receives neither a wireless communication signal nor a wireless audio signal, the signal processing module 30 executes step S5: determining whether an ambient sound signal is received.

After confirming that the wireless communication module 10 is receiving no wireless signal, the signal processing module 30 can further determine whether the sound receiving module 20 is receiving an ambient sound signal.

If an ambient sound signal is received, step S6 is executed: adjusting the ambient sound signal according to a third parameter.

The sound adjustment module 50 will read the third parameter from the memory module 40 to adjust the ambient sound signal which is received.

After step S2, step S4, or step S6, the sound adjustment module 50 executes step S7: generating and outputting an adjusted sound signal.

After the adjustment of step S2, step S4, or step S6 is executed, the sound adjustment module 50 adjusts the wireless communication signal, the wireless audio signal, or the ambient sound signal respectively to generate an adjusted sound signal. Finally, the output module 60 is used for outputting the adjusted sound signal to the user.

It is to be known that the order of the steps of the hearing aid communication method of the present invention is not limited to the abovementioned description and that the abovementioned order of steps can be changed as long as the object of the present invention can be achieved.

Thus, the user can use the audio transmission system 1 to adjust the sound signal under the different usage modes in the manual mode or the automatic mode so as to have the best hearing effect.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope of the invention.

What is claimed is:

1. An audio transmission system, used for establishing a connection with an electronic device and having a telephony usage mode, a music usage mode, and an ambient sound usage mode; the audio transmission system comprising:

a wireless communication module, for receiving a wireless communication signal or a wireless audio signal from the electronic device, wherein the wireless communication signal is used to execute the telephony usage mode and the wireless audio signal is used to execute the music usage mode;

a sound receiving module, for receiving an ambient sound signal, wherein the ambient sound signal is used to execute the ambient sound usage mode;

a signal processing module electrically connected to the wireless communication module and the sound receiving module for determining whether a wireless communication signal, a wireless audio signal, or an ambient sound signal is received, wherein:

when determining that a wireless communication signal is received, the signal processing module executes the telephony usage mode directly;

when determining that a wireless audio signal is received, the signal processing module executes the music usage mode directly; and when determining that an ambient sound signal is received, the signal processing module executes the ambient sound usage mode directly; wherein the telephony usage mode is a first processing order of the signal processing module, the music usage mode is a second processing order of the signal processing module, and the ambient sound usage mode is a third processing order of the signal processing module;

a memory module, for storing a first parameter, a second parameter, and a third parameter;

a sound adjustment module, electrically connected to the wireless communication module, the sound receiving module, and the memory module, for adjusting the wireless communication signal, the wireless audio signal, or the ambient sound signal which is received according to the first parameter, the second parameter, or the third parameter respectively so as to generate an adjusted sound signal, wherein:

when two or more of the wireless communication signal, the wireless audio signal, or the ambient sound signal are received at the same time, the signal processing module executes the telephony usage mode, the music usage mode, or the ambient sound usage mode to let the sound adjustment module adjust the wireless communication signal, the wireless audio signal, or the ambient sound signal according to the processing order; and an output module, electrically connected to the sound adjustment module, for outputting the adjusted sound signal.

2. The audio transmission system as claimed in claim 1, further comprising a selecting module for allowing a user to select the audio transmission system to execute only the telephony usage mode, the music usage mode, or the ambient sound usage mode.

3. The audio transmission system as claimed in claim 1, wherein the sound adjustment module is an equalizer for adjusting a gain value of the wireless communication signal, the wireless audio signal, or the ambient sound signal according to the first parameter, the second parameter, or the third parameter respectively.

4. The audio transmission system as claimed in claim 1, wherein the audio transmission system is a Bluetooth earphone.

5. An audio processing method, used for an audio transmission system, wherein the audio transmission system is used for establishing a connection with the electronic device and having a telephony usage mode, a music usage mode, and an ambient sound usage mode; the method comprising the following steps:

providing a wireless communication module for receiving a wireless communication signal or a wireless audio signal from the electronic device, wherein the wireless communication signal is used to execute the telephony usage mode and the wireless audio signal is used to execute the music usage mode;

providing a sound receiving module for receiving an ambient sound signal, wherein the ambient sound signal is used to execute the ambient sound usage mode;

setting the telephony usage mode as a first processing order, the music usage mode as a second processing order, and the ambient sound usage mode as a third processing order;

determining whether the wireless communication signal, the wireless audio signal, or the ambient sound signal is received;

when determining that a wireless communication signal is received, executing the telephony usage mode automatically to adjust the wireless communication signal according to a first parameter to generate an adjusted sound signal;

when determining that the wireless audio signal is received, executing the music usage mode automatically to adjust the wireless audio signal according to a second parameter to generate the adjusted sound signal;

when determining that the ambient sound signal is received, executing the ambient sound usage mode automatically to adjust the ambient sound signal according to a third parameter to generate the adjusted sound signal;

when the wireless communication signal, the wireless audio signal, or the ambient sound signal is received at the same time, executing the telephony usage mode, the music usage mode, or the ambient sound usage mode according to the processing order; and outputting the adjusted sound signal.

6. The audio processing method as claimed in claim 5, further comprising a step for allowing a user to select the audio transmission system to execute only one of the telephony usage mode, the music usage mode, or the ambient sound usage mode.

7. The audio processing method as claimed in claim 5, further comprising a step of adjusting a gain value of the wireless communication signal, the wireless audio signal, or the ambient sound signal according to the first parameter, the second parameter, or the third parameter respectively.

* * * * *